US012426630B2

(12) United States Patent
Phillips et al.

(10) Patent No.: US 12,426,630 B2
(45) Date of Patent: Sep. 30, 2025

(54) DISPOSABLE VAPORIZER CARTRIDGE

(71) Applicant: Blackship Technologies Development LLC, North Chesterfield, VA (US)

(72) Inventors: Donovan Phillips, North Chesterfield, VA (US); Yongjie Xu, North Chesterfield, VA (US)

(73) Assignee: Blackship Technologies Development LLC, North Chesterfield, VA (US)

( * ) Notice: Subject to any disclaimer, the term of this patent is extended or adjusted under 35 U.S.C. 154(b) by 1130 days.

(21) Appl. No.: 17/117,769

(22) Filed: Dec. 10, 2020

(65) Prior Publication Data

US 2022/0183355 A1 Jun. 16, 2022

(51) Int. Cl.

| | |
|---|---|
| ***A24F 40/42*** | (2020.01) |
| ***A24F 40/10*** | (2020.01) |
| ***A24F 40/46*** | (2020.01) |
| ***A24F 40/48*** | (2020.01) |

(52) U.S. Cl.

CPC ..... *A24F 40/42* (2020.01); *A24F 40/46* (2020.01); *A24F 40/48* (2020.01); *A24F 40/10* (2020.01)

(58) Field of Classification Search

None

See application file for complete search history.

(56) References Cited

U.S. PATENT DOCUMENTS

| | | | | |
|---|---|---|---|---|
| 9,675,118 | B2 | 6/2017 | Chen | |
| 9,814,265 | B2 | 11/2017 | Rinker et al. | |
| 10,172,388 | B2 | 1/2019 | Sears et al. | |
| 10,517,331 | B2 | 12/2019 | Atkins et al. | |
| 10,792,443 | B2 | 10/2020 | Xu et al. | |
| 2011/0155153 | A1 | 6/2011 | Thorens et al. | |
| 2016/0309785 | A1 | 10/2016 | Holtz | |
| 2018/0263290 | A1 | 9/2018 | Collett et al. | |
| 2019/0001077 | A1* | 1/2019 | Xu | A24F 40/44 |
| 2019/0364957 | A1 | 12/2019 | Fu et al. | |
| 2020/0000146 | A1 | 1/2020 | Anderson et al. | |
| 2020/0107585 | A1* | 4/2020 | Atkins | H05B 3/42 |

FOREIGN PATENT DOCUMENTS

| | | | |
|---|---|---|---|
| WO | 2020132079 | A1 | 6/2020 |
| WO | 2020223876 | A1 | 11/2020 |

OTHER PUBLICATIONS

International Searching Authority, International Search Report and Written Opinion, International Application No. PCT/US21/62532, Mar. 1, 2022, pp. 1-17.

* cited by examiner

*Primary Examiner* — Michael J Felton

(74) *Attorney, Agent, or Firm* — Nixon & Vanderhye P.C.

(57) ABSTRACT

A vaporizer cartridge has a cartridge case defining a case interior and being sized and configured for mating with a cartridge receiver. A flow passage within the case interior extends from a cartridge air inlet to a mouthpiece exit port. The vaporizer cartridge has a liquid reservoir, a resistive heating element, and a liquid transport structure. The resistive heating element has a central heating portion in electrical communication with two electrical contact tabs. The central heating portion is positioned adjacent the flow passage. The contact tabs extend outside the cartridge case and are configured for engagement by electrical contacts of the cartridge receiver when the cartridge case is mated to the cartridge receiver. The fluid transport structure has an intake surface and an outflow surface adjacent or in contact with the heating element and is configured for transfer of liquid from the reservoir to the outflow surface.

26 Claims, 13 Drawing Sheets

DISPOSABLE VAPORIZER CARTRIDGE

BACKGROUND OF THE INVENTION

The present invention relates generally to micro-vaporizers and, more particularly, to a vaporizer cartridge having a liquid reservoir and heating element that can be used in conjunction with a reusable vaporizer power and control unit.

Liquid vaporizing devices (referred to herein as vaporizers or micro-vaporizers) are devices in which a vaporizable liquid is drawn from a storage reservoir into a chamber where it is heated to vaporization temperature by a heating element. The vaporized liquid is then drawn or forced from the chamber. In products such as electronic cigarettes (also known as e-cigarettes or personal vaporizers), the vaporized liquid is drawn from the chamber through a mouthpiece and inhaled by the user. In other products the vaporized liquid is dispersed into the atmosphere.

Conventional micro-vaporizers use a wick to draw vaporizable liquid from a reservoir into a vaporization chamber where the liquid is brought into close proximity with the heating element. The heating element itself typically includes a coiled heating wire that may be positioned near a surface of the wick or, in some cases, may be wrapped around a portion of the wick. Many conventional vaporizers provide for refilling of the reservoir upon exhaustion of the vaporizable liquid. Refilling, however, can easily result in spillage or contamination. To avoid this issue, some vaporizers have been designed to accept a disposable liquid cartridge. In such designs, the main vaporizer body retains reusable components such as the mouthpiece, air and vapor product flow ducts, heating element and vaporization chamber, and, typically, the power source, which may be separately replaceable.

SUMMARY OF THE INVENTION

An illustrative aspect of the invention provides a vaporizer cartridge comprising a cartridge case having a plurality of cartridge case walls defining a cartridge case interior. The cartridge case is sized and configured for mating with a cartridge receiver. The vaporizer cartridge further comprises a flow passage within the case interior extending from a cartridge air inlet to a mouthpiece exit port. The cartridge air inlet and the exit port are each formed through one of the plurality of cartridge case walls. The vaporizer cartridge also comprises a liquid reservoir configured for receiving a vaporizable liquid therein, a resistive heating element, and a liquid transport structure. The resistive heating element has a central heating portion that is in electrical communication with positive and negative electrical contact tabs and that is positioned within the case interior adjacent a portion of the flow passage. The positive and negative contact tabs each extend outside the cartridge case through one of the plurality of cartridge case walls. The positive and negative contact tabs are configured for engagement by complementary electrical contacts of the cartridge receiver when the cartridge case is mated to the cartridge receiver. The fluid transport structure is disposed within the case interior and has an intake surface in fluid communication with the liquid reservoir and an outflow surface adjacent or in contact with the heating element. The fluid transport structure is configured for transfer of the vaporizable liquid from the reservoir to the outflow surface.

Another illustrative aspect of the invention provides a vaporizer comprising a vaporizer cartridge and a cartridge receiver. The vaporizer cartridge comprises a cartridge case having a plurality of cartridge case walls defining a cartridge case interior. The cartridge case has spaced apart proximal and distal ends. A flow passage within the case interior extends from a cartridge air inlet at or adjacent the distal end and a mouthpiece exit port at or adjacent the proximal end. The vaporizer cartridge further comprises a liquid reservoir having a vaporizable liquid disposed therein, a resistive heating element, and a fluid transport structure. The resistive heating element has a central heating portion in electrical communication with positive and negative electrical contact tabs. The central heating portion is positioned within the case interior adjacent a portion of the flow passage. The positive and negative contact tabs each extend outside the cartridge case through one of the plurality of cartridge case walls. The fluid transport structure is disposed within the case interior and has an intake surface in fluid communication with the liquid reservoir and an outflow surface adjacent or in contact with the heating element. The fluid transport structure is configured for transfer of the vaporizable liquid from the liquid reservoir to the outflow surface. The cartridge receiver comprises a receiver case having a plurality of receiver case walls collectively defining a receiver case interior and a cartridge receiving cavity. the cartridge receiving cavity is separated from the receiver case interior by a cavity base wall and is configured for slidably receiving at least a distal portion of the cartridge case therein. Positive and negative receiver contacts are mounted to the base wall so that when the at least a distal portion of the cartridge case is fully received into the cartridge receiving cavity, the positive and negative receiver contacts each make physical and electrical contact with a respective one of the positive and negative contact tabs. The cartridge receiver also comprises a power source disposed within the receiver case interior and activation control circuitry. The activation control circuitry is in electrical communication with the power source and the receiver contacts and is configured for selectively connecting the power source to the receiver contacts, thereby energizing the resistive heating element when the at least a portion of the cartridge case is fully received into the cartridge receiving cavity.

BRIEF DESCRIPTION OF THE DRAWINGS

The invention can be more fully understood by reading the following detailed description together with the accompanying drawing, in which like reference indicators are used to designate like elements, and in which.

DETAILED DESCRIPTION OF THE INVENTION

Figure 1A:
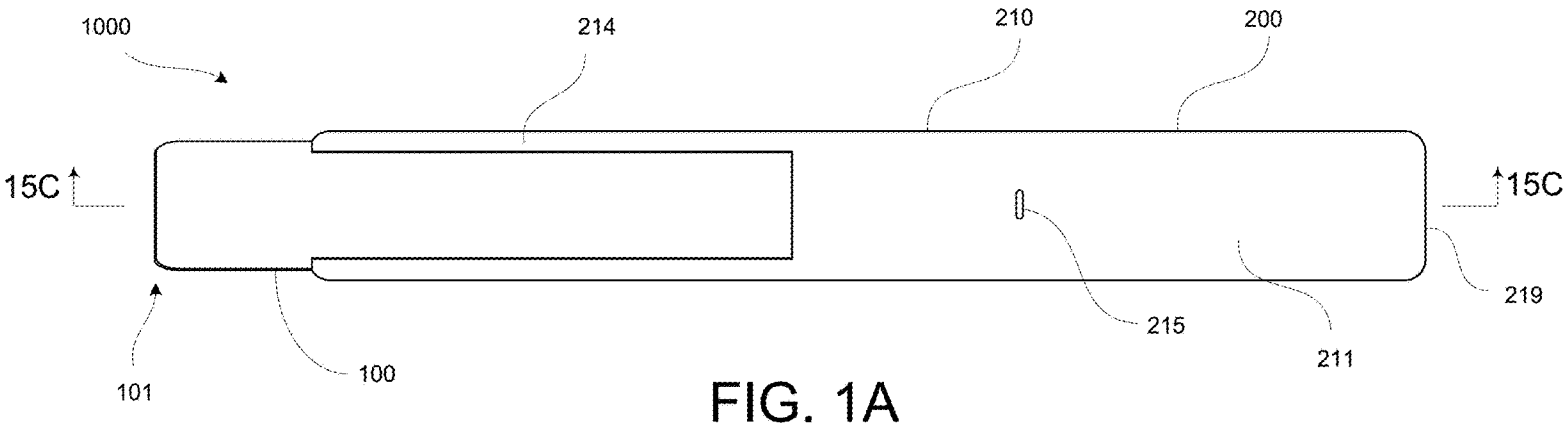
FIGS. 1A, 1B, 1C, and 1D are top, side, bottom and front views, respectively, of vaporizer system according to an embodiment of the invention.
Figure 1B:
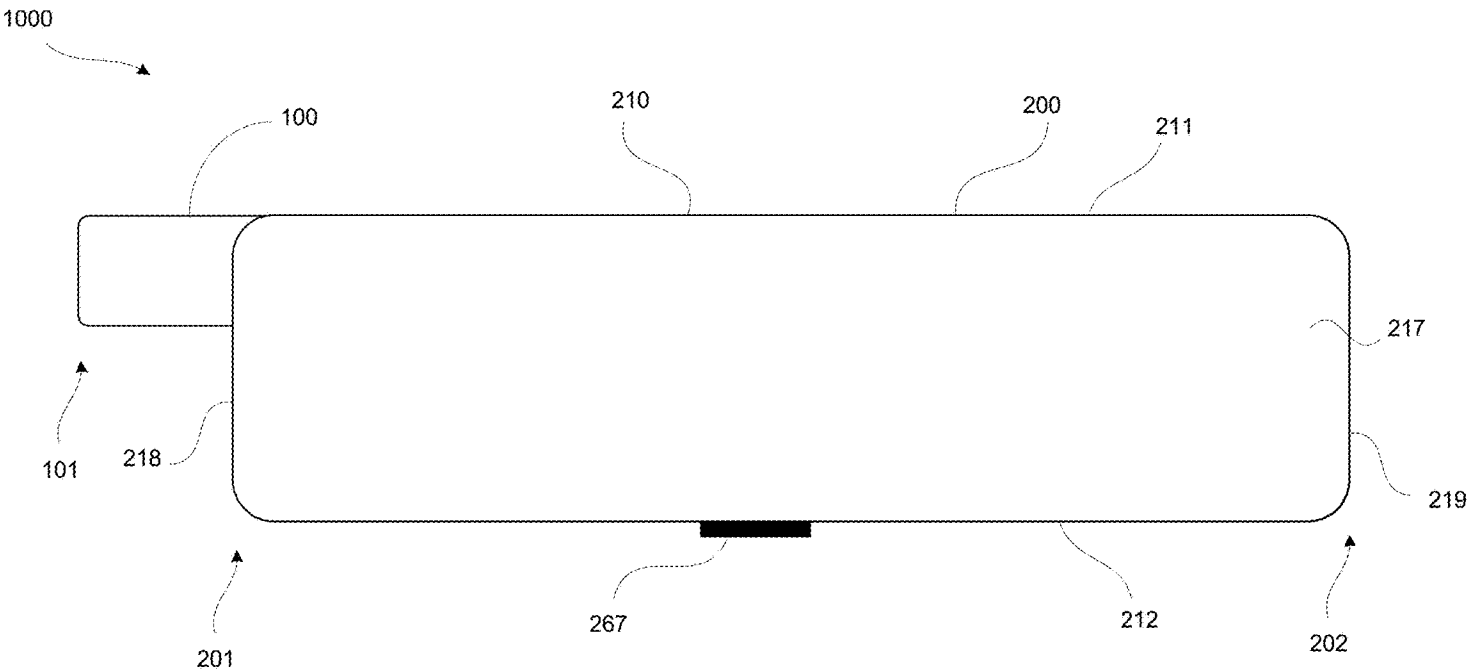
Figure 1C:
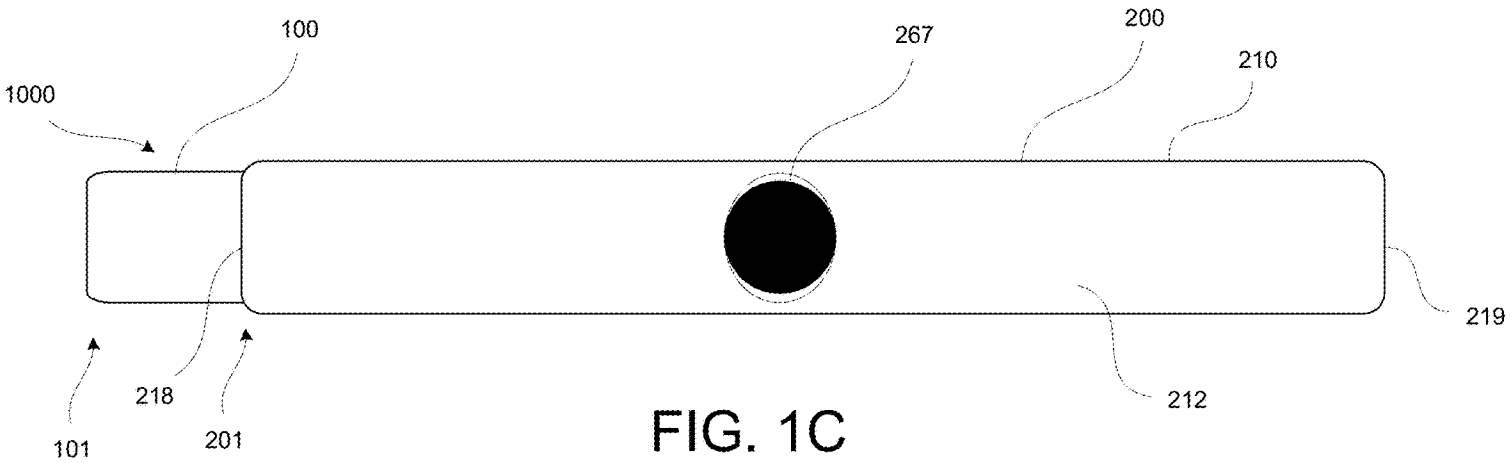
Figure 1D:
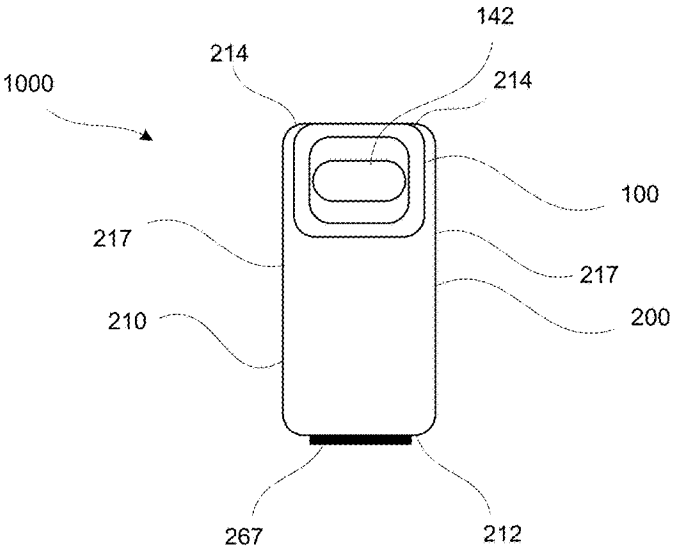

Conventional micro-vaporizers have a reservoir from which vaporizable liquid is drawn (typically through the use of a wick) to a vaporization chamber. There the liquid is brought into close proximity with a heating element. The heating element and, generally, a portion of the wick are disposed within the vaporization chamber. When the heating element is activated, the liquid from the wick is vaporized/aerosolized. The resulting vaporization products and unvaporized liquid are mixed with air that is drawn from outside the device into the vaporization chamber. The mixture is then released from or drawn out of the device.

Embodiments of the present invention provide modular vaporizers that make use of disposable cartridges that include, not only a vaporizable liquid reservoir, but a heating element as well. Cartridges according to the invention may also include complete air and vapor product flow passages, including a vaporization/mixing chamber and an integrated mouthpiece. These cartridges are configured for mating with a reusable cartridge receiver that retains a power source and operational circuitry. When joined with a cartridge receiver, a reusable cartridge of the invention establishes electrical contact with the circuitry of the receiver so that the mated vaporizer system operates like a conventional vaporizer. Upon exhaustion of the liquid from the cartridge reservoir, the cartridge can be removed, discarded, and replaced with another cartridge.

FIGS. 1A-1D illustrate a modular vaporizer system 1000 according to an illustrative embodiment of the invention. The vaporizer system 1000 includes a vaporizer cartridge 100 and a cartridge receiving unit (or cartridge receiver) 200. The FIG. 1 illustrate the cartridge 100 and the cartridge receiver 200 in their mated, operational configuration in which the cartridge 100 is partially received inside the case 210 of the cartridge receiver 200. As will be discussed in more detail, in this configuration, the vaporizer system 1000 may be operated like a conventional vaporizer. The receiver case 210 has an air inlet 215 formed through an upper wall 211 that provides air for mixture with vaporized liquid inside the vaporizer system 1000. An activation switch 267 in the form of a push button extends through a lower wall 212 of the receiver case 210. Pressing this button causes activation of a heater within the vaporizer that vaporizes liquid from a reservoir. The vaporization products are mixed with air and passed through a flow passage that terminates at a mouthpiece exit 142 at its proximal end 101.

As used herein, the terms proximal and distal are used to define relative locations along a longitudinal axis of the vaporizer system 1000, with proximal indicating a direction toward a user during inhalation use of the system 1000 and distal indicating a direction away from the user.

Figure 2:
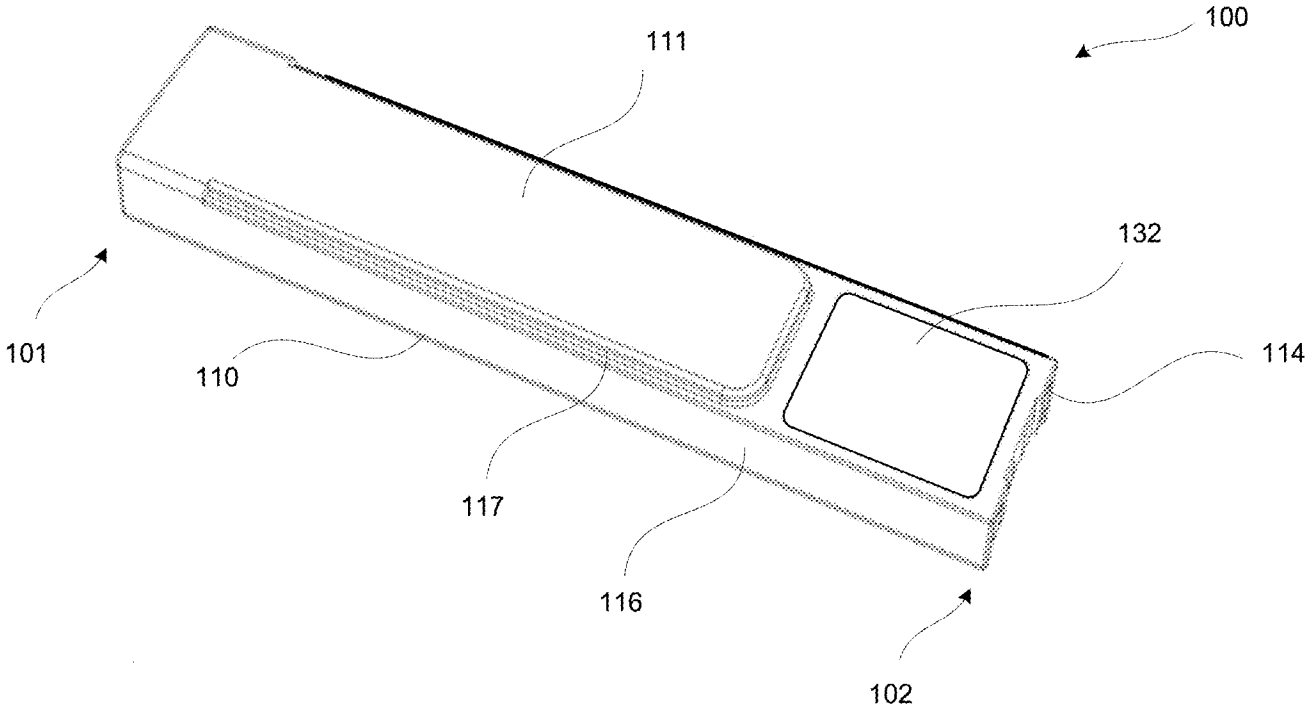
FIG. 2 is a perspective views of a vaporizer heating cartridge according to an embodiment of the invention.
Figure 3:
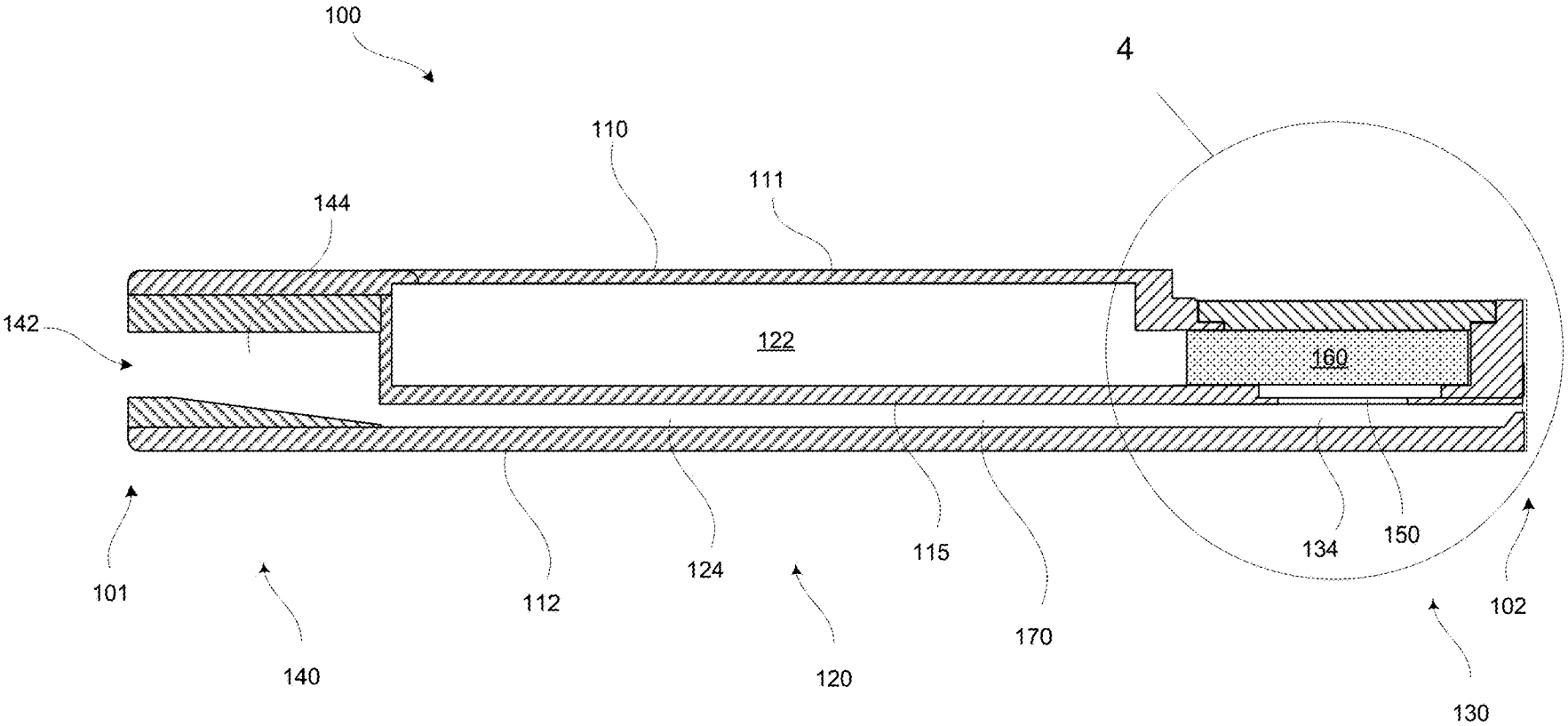
FIG. 3 is a section view of vaporizer heating cartridge according to an embodiment of the invention.
Figure 4:
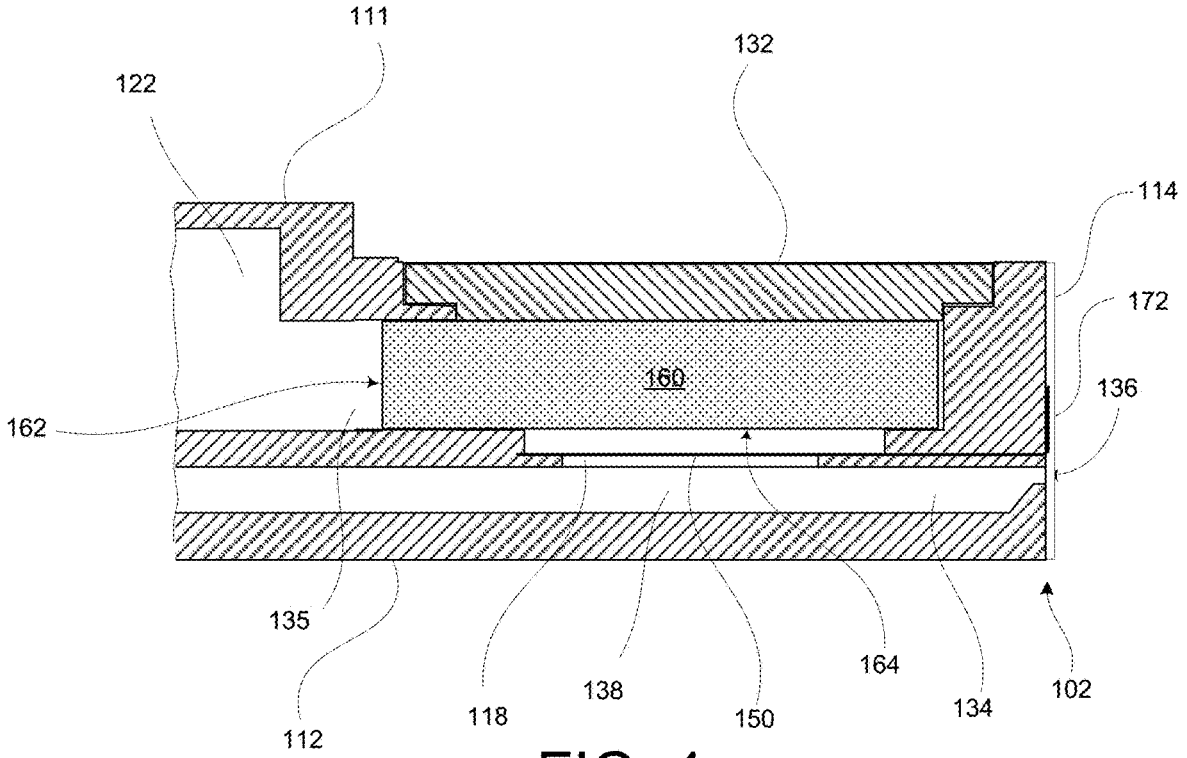
FIG. 4 is a section view of a portion of the vaporizer heating cartridge of FIG. 3.

The features of the vaporizer system 1000 and, in particular, the vaporizer cartridge 100, will now be discussed in more detail. With reference to FIGS. 2-4, the cartridge 100 has a mouthpiece section 140 adjacent a proximal end 101, a heating section 130 adjacent a distal case end 102, and a reservoir section 120 in a central area between the mouthpiece section 140 and the heating section 130. A cartridge case 110 defining at least the reservoir and heating element sections 120, 130 has upper and lower case walls 111, 112 and side walls 113, 116. The upper, lower and side case walls 111, 112, 113, 116 and inner case wall 115 collectively define a liquid reservoir space 122 and, along with the distal end wall 114, a receiving well 133 for disposition of a liquid transport structure 160. The lower and side case walls 112, 113, 116 and inner case wall 115 also collectively define a vaporization product flow passage 124, a vaporization/mixing chamber 138, and an air inlet passage 134, which collectively form an overall flow passage 170 that terminates at an air inlet port 136 through the distal case wall 114. The reservoir space 122 and the receiving well 133 are collectively formed to provide a reservoir passage 135 for fluid communication between the reservoir 122 and the receiving well 133. The inner wall 115 has a vaporization products window 118 formed there-through to provide fluid communication between the receiving well 133 and the passage 170. As will be discussed, the thin plate heating element 150 is positioned so as to span the vaporization products window 118.

The cartridge case 110 may be formed as a single integral structure or may be made up of multiple sub-structures. In particular embodiments, the cartridge case 110 may be formed as a single or multiple molded plastic structure or structures. In a particular embodiment, the cartridge case walls 111, 112, 115, 116, 118 are integrally formed as a single molded plastic body with the heating element 150 held within the molded structure.

The mouthpiece section 140 may be formed as an integral part of the main cartridge case 110 or may be formed as a separate structure that is permanently attached to the case structure by bonding or welding. The mouthpiece section defines an exit chamber 144 in fluid communication with an exit port 142 at the cartridge's proximal end 101. The exit chamber 144 is also in fluid communication with the flow passage 170 through the reservoir and heater sections 120, 130 so that inhalation at the exit port 142 produces flow potential across the inlet port 136 and the vaporization window 118.

The reservoir section 120 comprises the vaporization products portion 124 of the flow passage 170 and the reservoir space 122. The upper wall 111 serves to define the upper boundary of the reservoir 122. As best seen in FIG. 2, the portion of the upper wall 111 in the reservoir section may include parallel slide grooves 117 configured to slidably receive a portion of a guide rail mounted to the cartridge receiver 200.

Figure 5:
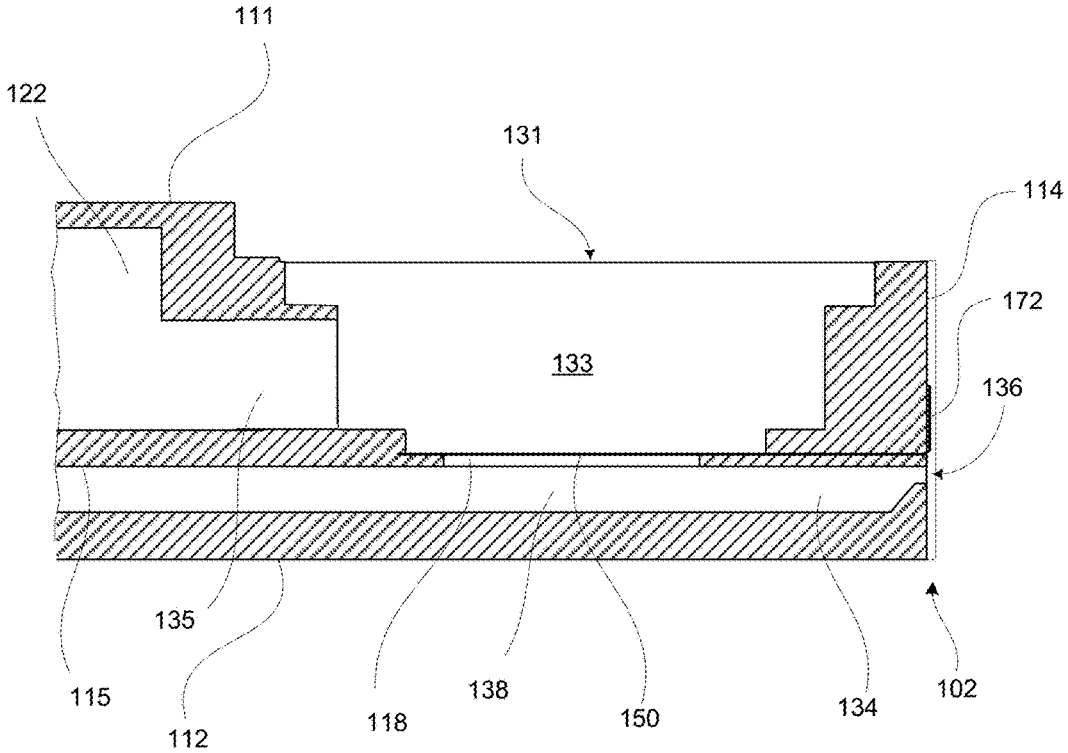
FIG. 5 is a section view of a portion of the case structure and the heating element of the vaporizer heating cartridge of FIG. 3.
Figure 12:
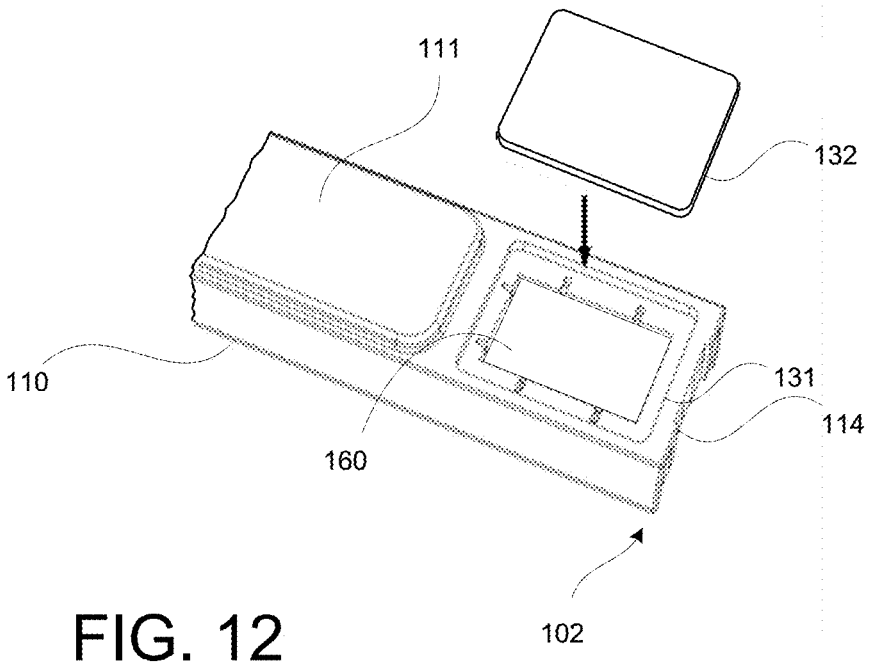
FIG. 12 is a perspective view of a portion of the vaporizer heating cartridge of FIG. 10 prior to installation of the access closure element.
Figure 13:
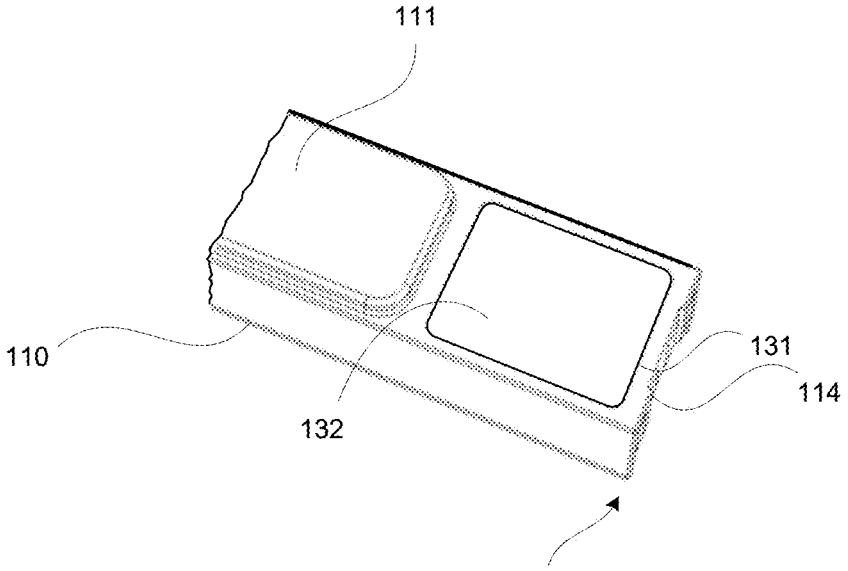
FIG. 13 is a perspective view of a portion of the vaporizer heating cartridge of FIG. 10 after installation of the access closure element.
Figure 14:
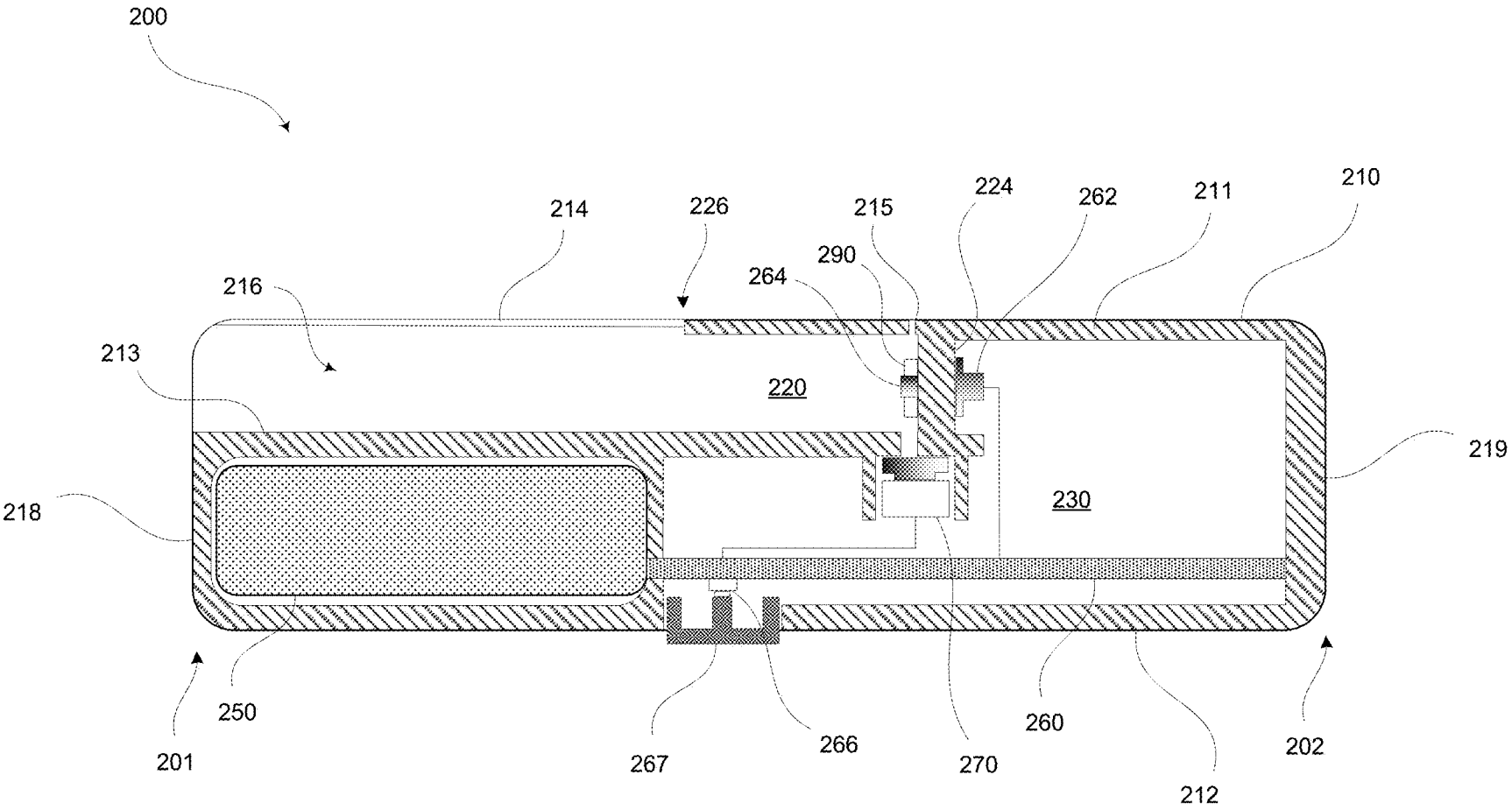
FIG. 14 is a section view of a cartridge receiver according to an embodiment of the invention.

As best seen in FIG. 5, the upper case wall 111 has an access opening 131 formed there-through. The access opening 131 is sized and configured to allow access to the receiving well 133 during the construction of the cartridge 100. As best seen in FIGS. 4, 12 and 13, a top wall closure member 132 may be received into the access opening 131 to rest on a closure support ledge 122 in the interior 120, thereby closing off the opening 131.

The liquid reservoir 122 may be configured as a simple tank in which vaporizable liquid may be disposed. In some embodiments, the reservoir 122 may have an adsorptive or absorptive material or structure disposed therein that retains the vaporizable liquid.

The heater section 130 is configured for retaining a thin plate heating element 150 adjacent the vaporization window 118 and for receiving a liquid transport structure 160 configured for transferring vaporizable liquid from the reservoir 122 to an area adjacent the heating element 150. The cartridge case 110 may be configured so that at least a portion of the cartridge heater section 130 is sized to allow it to be received into a receiving cavity of the cartridge receiver 200. In the illustrated embodiment, the upper wall 111 is configured so that the maximum vertical thickness of the heater section 130 is smaller than that of the reservoir section 120.

While any flat plate heating element may be usable in embodiments of the invention, in preferred embodiments, the heating element 150 has a central portion configured for heating vaporizable liquid at or adjacent an outflow surface of the fluid transport structure 160 and a peripheral portion that supports the central heating portion and connects the central heating portion to a power source. Heating elements of this type are disclosed in U.S. application Ser. No. 17/117,373, filed Dec. 10, 2020 and U.S. application Ser. No. 17/117,510, filed Dec. 10, 2020, the complete disclosures of which are incorporated herein by reference. The heating element 150 may be configured so that the only contact between the heating element 150 and the case structure 110 is through the peripheral portion of the heating element. This isolation of the central heating portion allows the use of case materials that would otherwise be unable to withstand the heat generated by the heating element 150.

Figure 6:
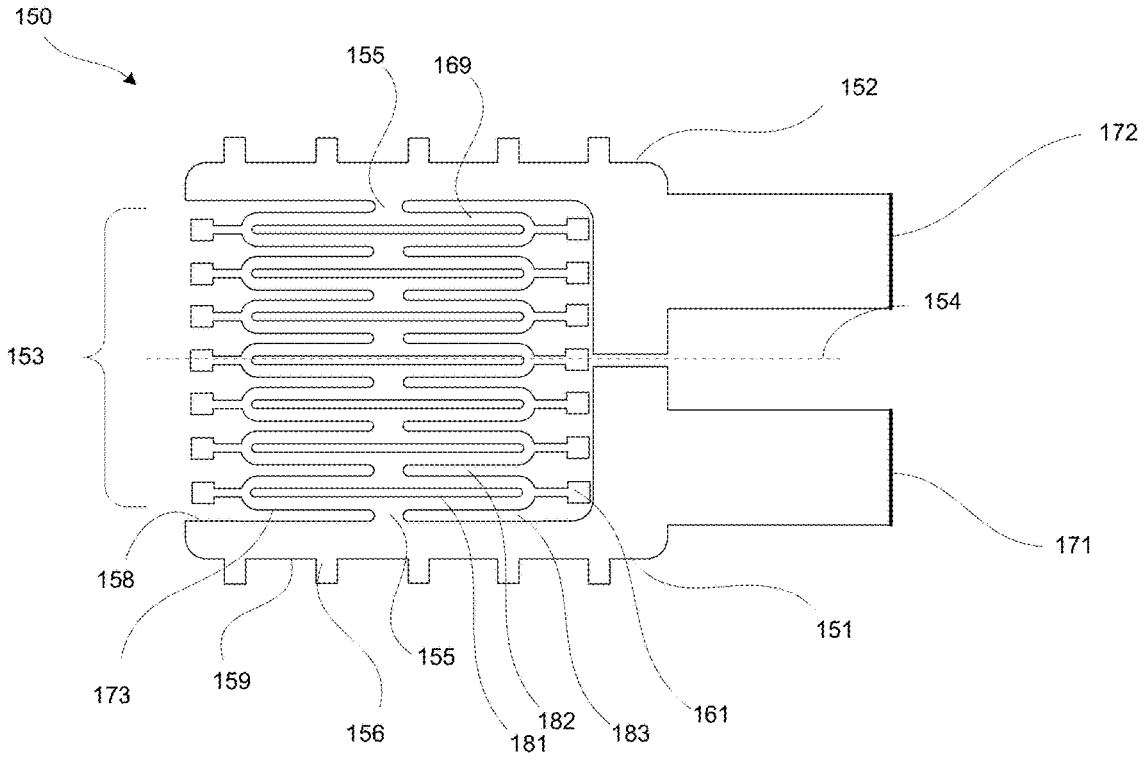
FIG. 6 is a top plan view of a thin plate heating element usable in embodiments of the invention.

FIG. 6 illustrates an exemplary thin plate heating element 150 usable in embodiments of the invention. The heating element 150 is formed from a single planar sheet of electrically conductive material having a constant sheet thickness. The material and thickness used may be selected to provide a desired combination of electrical and thermal properties as well as a desired degree of structural integrity and/or rigidity. Illustrative materials that could be used include carbon, graphite, metals, metal alloys, electrically conductive ceramics (such as, for example, molybdenum disilicide), and composite materials made of a ceramic material and a metallic material. Composite materials may include doped ceramics such as doped silicon carbides. Suitable metals may include titanium, zirconium, tantalum and metals from the platinum group. Suitable metal alloys may include nichrome, kanthal, stainless steel, constantan, nickel-, cobalt-, chromium-, aluminum-, titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminum based alloys and iron-manganese-aluminum based alloys. Typical sheet thicknesses for such materials may be in a range of 0.00005 in. to 0.15000 in.

Thin plate heating elements usable in the present invention may be manufactured from a single thin sheet of conductive material. Features of the heating element may be formed by cutting a pattern of channels through the material to provide a flow path for vaporizable liquid and vaporization products to flow through. This may be accomplished, for example, using any suitable cutting tool (e.g., a laser or water jet) or by punching or chemical etching.

The resulting thin plate heating element body 150 has a peripheral conduction portion made up of a positive support arm 151 and a negative support arm 152 and a central heating portion 153 positioned between the support arms 151, 152. The support arms 151, 152 have interior edges 158 facing inward toward one another and toward the central heating portion 153 and exterior lateral edges 159 facing outward. The interior edges 158 are parallel to one another and to a longitudinal axis 154. The positive support arm 151 includes a positive contact tab 171 and the negative support arm 152 includes a negative contact tab 172 extending in a longitudinal direction away from the central heating portion 153. As will be discussed the positive and negative contact tabs 171, 172 are configured to extend outside the cartridge 100 so as to establish electrical contact with corresponding elements of an electrical power circuit in the cartridge receiver 200.

In particular embodiments, the heating element 150 may have a plurality of peripheral support tabs 156 extending laterally outward from the exterior edges 159 of the support arms 151, 152. These tabs 156 may be sized and configured to engage surfaces or to be engaged by other structures in order to support and/or hold the heating element 150 in place within the case structure 110.

The central heating portion 153 of the heating element 150 is made up of an array of spaced apart but interconnected heating strips 169. These heating strips 169 are parallel to one another and to the longitudinal axis 154. In particular embodiments and as illustrated in FIG. 6, the heating strips 169 are divided in to pairs, with the strips 169 of each pair being connected to one another at both ends to form a heating element loop 173 surrounding a through channel 181 through the material. In the illustrated embodiment, the loop ends are arcuate, but it will be understood that in other embodiments, the end connections could be straight, thereby forming a "squared off" loop. Adjacent heating element loops 173 are connected to one another by a lateral strip. Adjacent strips 169 of adjacent loops 173 combine with the adjoining lateral strips to define through channels 182 between the adjacent loops 173. The two heating loops 173 adjacent to the interior edges 158, 159 are each connected to the adjacent interior edge 158 by a lateral bridge strip 155. The side strips 169 of these loops 173 combine with their adjacent interior edges 158 and the lateral bridge strips 155 to define through channels 183 between the loops 173 and the supporting arm edges 158, 159.

In particular embodiments, the central heating portion 153 includes central support tabs 161 extending longitudinally from the ends of the heating strips 169. As shown in the illustrated embodiment, the central support tabs 161 may extend from the ends 166 of the heating element loops 160. Each central support tab 161 may be T-shaped with a stem 167 and a rectangular head 168. The tabs 161 may be sized and configured to engage surfaces or to be engaged by other structures in order to support and/or hold the central heating portion 153 of the heating element 150 in place within the structure of a micro-vaporizer. While the illustrated embodiment has two tabs 161 for each loop 160, it will be understood that in other embodiments, some loops 160 may have a tab 161 at just one end or may have no tabs 161 at all.

The two lateral bridge strips 155 serve to electrically connect the central heating portion 153 to the positive and negative support arms 151, 152. Aside from the bridge strips 155, the central heating portion 153 is otherwise isolated from the supporting arms 151, 152, thereby minimizing heat conduction from the central heating portion 153 to the supporting arms 151, 152. The array of heating strips 169 of the central heating portion 153 may be sized and configured to produce a heating profile for heating the spaces on both sides of the heating element 150 and vaporizable liquid within these spaces and/or passing through the channels 181, 182, 183. The array of heating strips 169 in combination with the support arms 151, 152 may also be sized to produce a particular flow area for passage of liquid and vaporization products through the heating element 150. The combination may be further configured to provide a desired overall heating element electrical resistance (i.e., the resistance between the positive and negative contact tabs 171, 172). Suitable combinations may provide an overall heating element resistance in a range of 0.0010 ohm to 5.2000 ohms. In certain embodiments, suitable combinations have been structured to provide an overall resistance in a range of 0.0015 ohm to 3.00000 ohms, and in more particular embodiments, in a range of 0.3500 ohm to 0.8000 ohm. It will be understood that the specific configuration of the central heating portion 254 and/or thickness of the heating element 250 may be tailored (in some cases, along with the power source) to the vaporizable liquid. For example, some liquids such as those containing CBD, may need to be vaporized at a lower power to prevent scorching or burning.

As best shown in FIG. 5, the thin plate heating element 150 is disposed so that a portion of each support arm is embedded in the case structure 110 at the bottom of the receiving well 133. This may be accomplished by molding some or all of the case structure around the heating element 150. The heating element 150 may be positioned so as to span the vaporization window 118 and so that the peripheral portion of the heating element 150 is partially embedded within the internal case wall 115. This allows the placement of the central heating portion 153 in registration with the vaporization chamber window 118. In this way, the heating element's upper surface faces upward the interior of the receiving well 133 the heating element's lower surface faces downward through the vaporization chamber window 118.

It can be seen that the thin plate heating element 150 is positioned so that it is parallel to the direction of air flow into and through the vaporization/mixing section 138 of the flow passage 170 and so that it, in effect, provides a part of the boundary surrounding the vaporization/mixing section 138.

Figure 7:
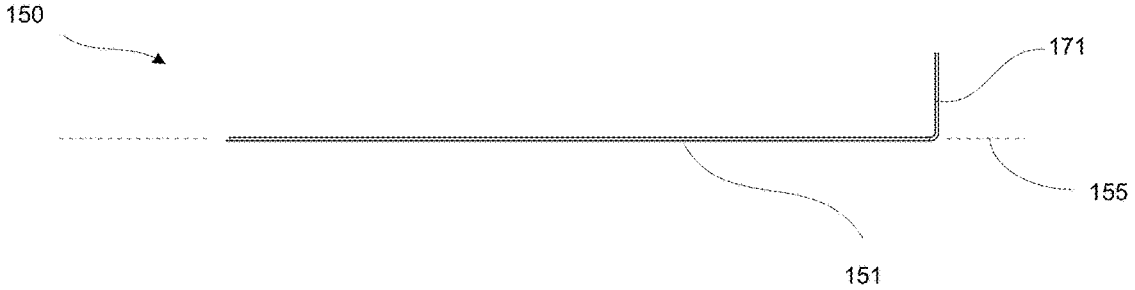
FIG. 7 is a side view of the thin plate heating element of FIG. 6.
Figure 8:
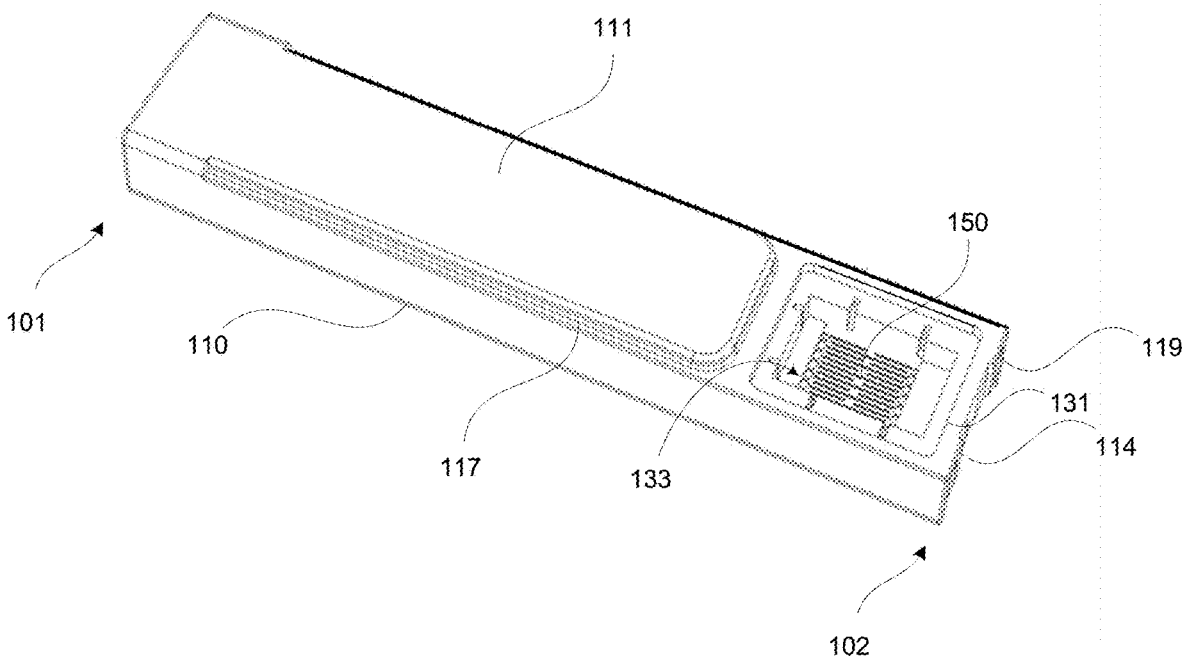
FIG. 8 is a perspective view of the case structure and the heating element of a vaporizer heating cartridge according to an embodiment of the invention.

The thin plate heating element 150 is further positioned so that the positive and negative contact tabs 171, 172 extend outward through the distal case wall 114. As shown in FIG. 7, a portion of each contact tab 171, 172 may extend from the main body of the heating element 150 at a 90 degree angle. This allows the contact tabs 171, 172 to be partially embedded within or held in contact with the outer surface of the distal case wall 114. This leaves one surface of each tab exposed so that it can be contacted for establishing electrical communication. In some embodiments, a portion of the outer surface of the distal case wall 114 may be recessed to receive the contact tabs 171, 172.

The receiving well 133 is sized and configured to receive a liquid transport structure 160 configured to transfer vaporizable liquid from the reservoir 122 to an area at or adjacent the upper surface of the flat plate heating element 150. As previously discussed, the internal case structure is configured to provide a reservoir passage 135 connecting the reservoir 122 and the receiving well 133. The reservoir passage 135 may be sized and configured to receive a portion of the liquid transport structure 160 so that an intake surface 162 of the liquid transport structure 160 will be in contact with liquid disposed within the reservoir 122. In some embodiments, the liquid transport structure 160 may be sized to extend through the passage 135 into the reservoir 122.

The liquid transport structure 160 is configured for drawing vaporizable liquid from the reservoir 122*c* through the upstream intake surface 162 into the structure 160 and transporting the liquid to the downstream outflow surface 164 where the liquid may be heated to vaporization by the heating element 150. The liquid transport structure 160 may be or comprise a wick or collection of wicking material. Typical personal vaporizer wicks are formed from organic fiber materials such as cotton, jute, flax, cellulose, or hemp. Some inorganic materials such as silica, carbon, and non-organic polymer fibers, ceramics and steel mesh may also be used. In general, vaporizer wicks can be formed from any material that is thermally stable and that provides sufficient wicking action to transport the vaporizable liquid from the reservoir to the heating element 150. The liquid transport structure 160 may also comprise a composite wick formed from a combination of wicking materials and active materials. The liquid transport structure may, in particular be or include any of the composite wicks disclosed in U.S. patent application Ser. No. 15/639,139, filed Jun. 30, 2017 (the "'139 Application"), the complete disclosure of which is incorporated herein by reference in its entirety. Composite wick materials may include woven or non-woven fibrous wicking materials in combination with embedded, trapped, adhered or alternately layered active additive materials. They are generally configured so that, in transport from the liquid reservoir, the vaporizable liquid must come into contact with the active additive materials. Portions of the active additive materials may be released into the fluid or may otherwise affect or impart desired characteristics to the liquid.

While the liquid transport structure 160 in the illustrated embodiment is configured as a rectangular block, it will be understood that other shapes may be used including cylinders, flat sheets or bent elongate elements. It will also be understood that the receiving well 133 may be shaped to receive and retain various shaped transport structures 160.

As used herein, the term "active material" refers to any material that controllably alters or adds to the vaporization products of the device. Depending on the application, active materials can include, without limitation, plant material, minerals, deodorizing agents, fragrances, insect repellants, medications, and disinfectants and any material or structure containing or incorporating any of the foregoing.

In the specific instance of personal vaporizers, active materials may include flavorant substances that augment the flavorant of the vaporizable liquid. These may include, without limitation, marijuana, hemp, cannabidiol (cbd), citronella, geraniol, mint, thyme, tobacco, salvia dorrii, salvia, Passiflora incarnata, arctostaphylos uva-ursi, lobelia inflata, lemon grass, cedar wood, clove, cinnamon, coumarin, helio, vanilla, menthol, eucalyptus, peppermint, rosemary, lavender, licorice, and cocoa and any material or structure containing or incorporating any of the foregoing.

The configuration of the heater section 130 provides for straight-forward final assembly of the cartridge 100. As shown in FIGS. 10-13, the access opening 131 is sized to allow insertion of the liquid transport structure 160 into the receiving well 133 and, optionally, into the reservoir passage 135. The wall closure member 132 may then be positioned and attached to the case 110 so as to seal off the access opening 131. A vaporizable liquid may then be added to the reservoir 122 through a sealable fill port (not shown), making the vaporizer cartridge 100 ready for use.

As shown in FIG. 4, the upper surface of the thin plate heating element 150 is in close proximity to the outflow surface 164 of the liquid transport structure 160. When the heating element 150 is energized, vaporizable liquid within the liquid transport structure 160 adjacent the outflow surface 164 is heated to vaporization. When a pressure drop is applied outside the vaporization window 118 (e.g., as the result of inhalation by a user at the exit port 142), vaporized and unvaporized liquid will be drawn from the outflow surface 164 and through the flow channels 181, 182, 183 of the heating element 150. This will serve to further heat the vaporization products to vaporize any unvaporized liquid. The resulting products may be further heated within the vaporization/mixing section 138. The pressure drop may also serve to draw additional vaporizable liquid from the reservoir into and through the transport structure 160.

The vaporizer cartridge 100 is essentially a self-contained vaporizer device, lacking only the circuitry and power source for energizing the heating element 150. These elements are provided by mating the cartridge 100 with the cartridge receiver 200.

The cartridge receiver 200 has proximal and distal ends 201, 202 and a receiver case 210 having upper and lower receiver case walls 211, 212, side case walls 217, and proximal and distal end walls 218, 219. The receiver case 210 also has a middle case wall 213 and a cavity base wall 224 that, when combined with the outer case walls 211, 212, 217, 218, 219 define a case interior space 230.

The case interior space 230, which may have additional supporting structure disposed therein, is configured for disposition of a power source 250 and a control system circuit board 260 configured for selectively providing power to positive and negative electrodes 262 (only one shown) mounted to and through the cavity base wall 224. The electrodes 262 extend through the base wall 224 and terminate in positive and negative electrode contacts 264, respectively (only one shown). The electrodes 262 are sized and positioned so that the electrode contacts 264 line up with the positioning of the contact tabs 171, 172 of the flat plate heating element 150 when the cartridge 100 is mated with the receiver 200. The power source 250 may be any battery capable of providing the voltage necessary to produce the desired temperatures in the thin plate heating element 150.

A button switch 266 operatively connected to the control system circuit board 260 may be configured to allow the user to selectively energize the electrode power circuit. A spring-loaded and/or elastic button cover 267 may be positioned in line with the button switch 266 within an opening in the lower case wall 212. The button cover 267 may be further configured to seal the case wall opening to prevent contamination of the interior 230. The electrode power circuit may have, in addition to or instead of the button switch 266, an air pressure switch 270 in fluid communication with the cartridge cavity 220 (described below). The air pressure switch 270 may be configured to respond to application of a pressure differential (e.g., due to inhalation of a user at the exit port 142 of the cartridge 100 when mated to the receiver 200) to close the circuit to energize the electrodes 262. The use of this type of switch provides an automatic system that activates the vaporizer upon inhalation without additional action by the user.

Figure 15A:
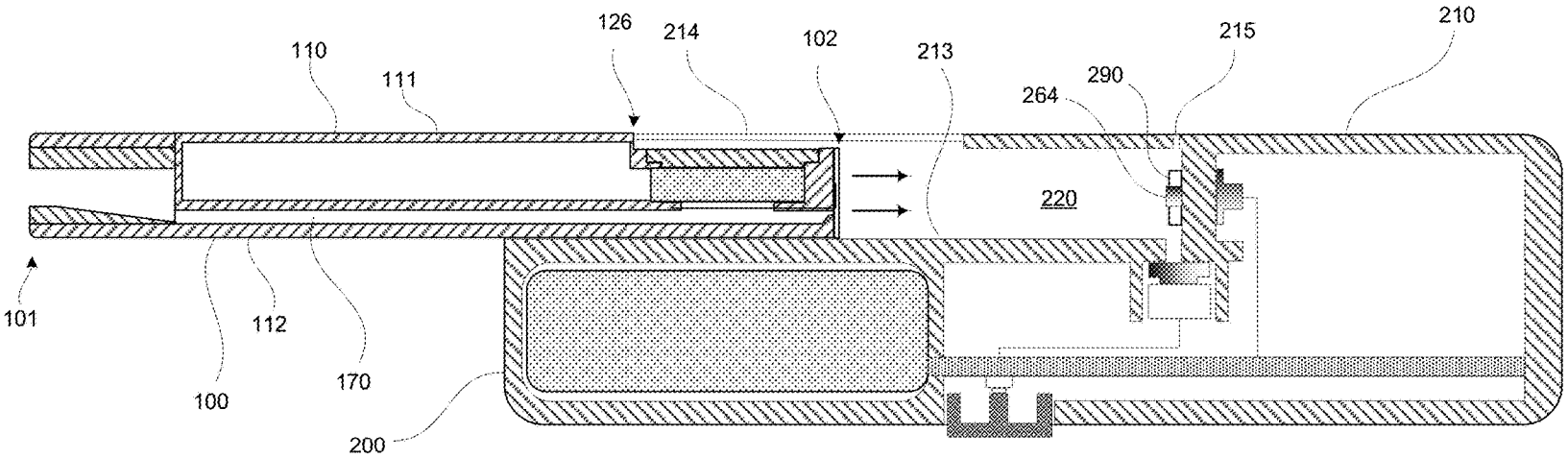
FIGS. 15A, 15B, and 15C are section views illustrating a mating sequence for a vaporizer heating cartridge and a cartridge receiver according to an embodiment of the invention.
Figure 15B:
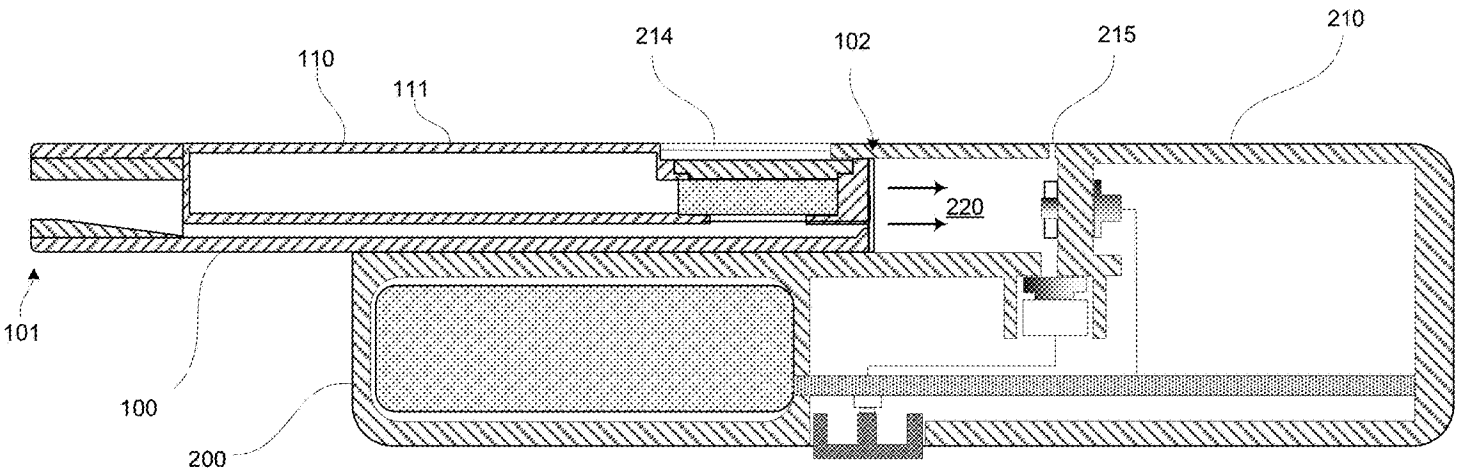
Figure 15C:
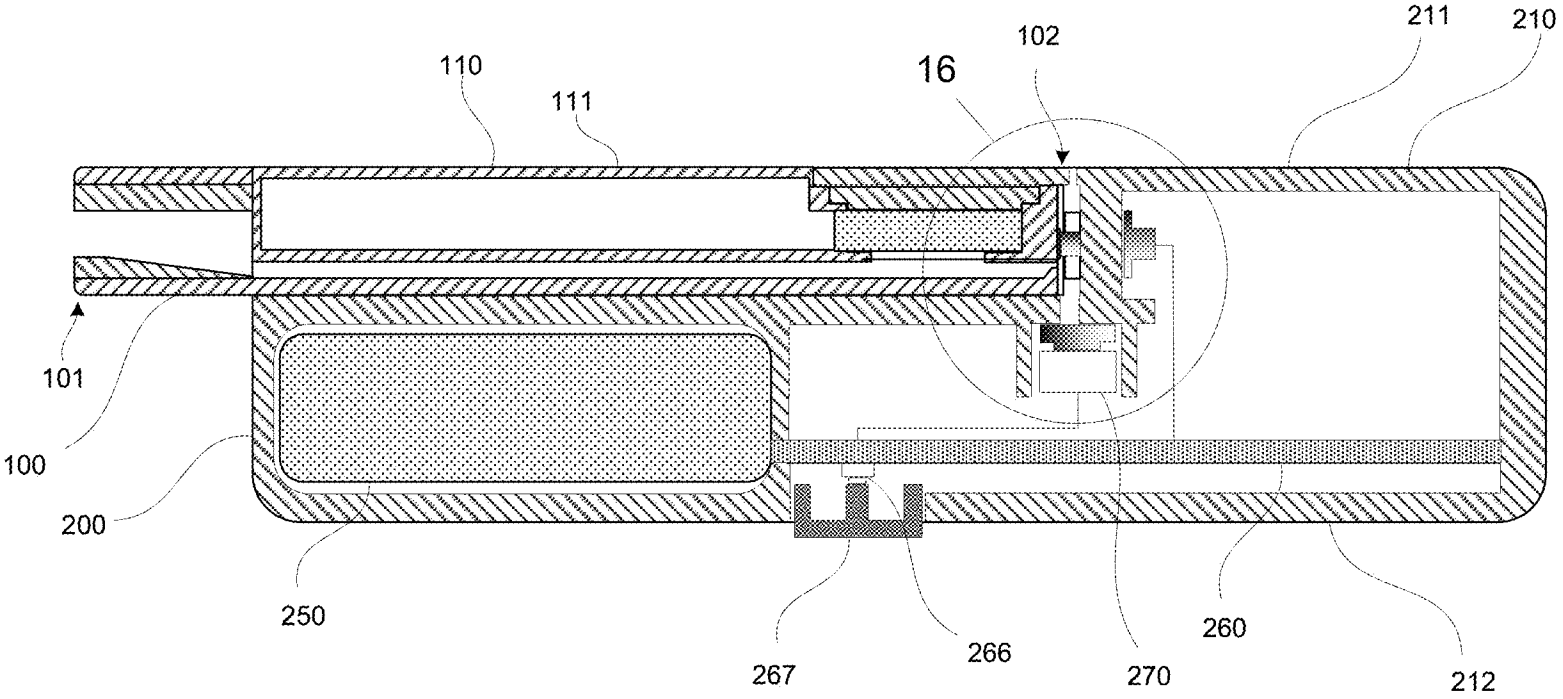

The upper wall 211 cooperates with the side walls 217, middle wall 213, and cavity base wall 224 to define a cartridge receiving cavity 220 that is sized and configured to slidably receive some or all of the heater section 130 of the cartridge 100 therein. A receiver air inlet port 215 is formed through the upper case wall 211 into the cavity 220 adjacent the base wall 224. A pair of guide rail extensions 214 extend proximally from the proximal end 226 of the upper wall 211 and laterally inwardly from the side walls 217. The guide rail extensions 214 are configured to slidably engage the slide grooves 117 of the cartridge 100 to guide the cartridge 100 into position as shown in the sequence illustrated in FIGS. 15A-15C. In FIG. 15A, the leading edge 126 of the reservoir section portion of the upper cartridge case wall 111 has been introduced into the space between the guide rail extensions 214 so that the extensions 214 are received into the slide grooves 117. In FIG. 15B, the cartridge 100 has been advanced in the direction of the arrows to a point where the distal end 102 of the cartridge 100 has been received into the cartridge receiving cavity 220. In FIG. 15C, the heater portion 130 of the cartridge 100 has been fully received into receiving cavity 222. In this operational configuration, as best illustrated in FIG. 16, the electrode contacts 264 make physical and electrical contact with the contact tabs 171, 172 adjacent the distal wall 114 of the cartridge 100.

Figure 16:
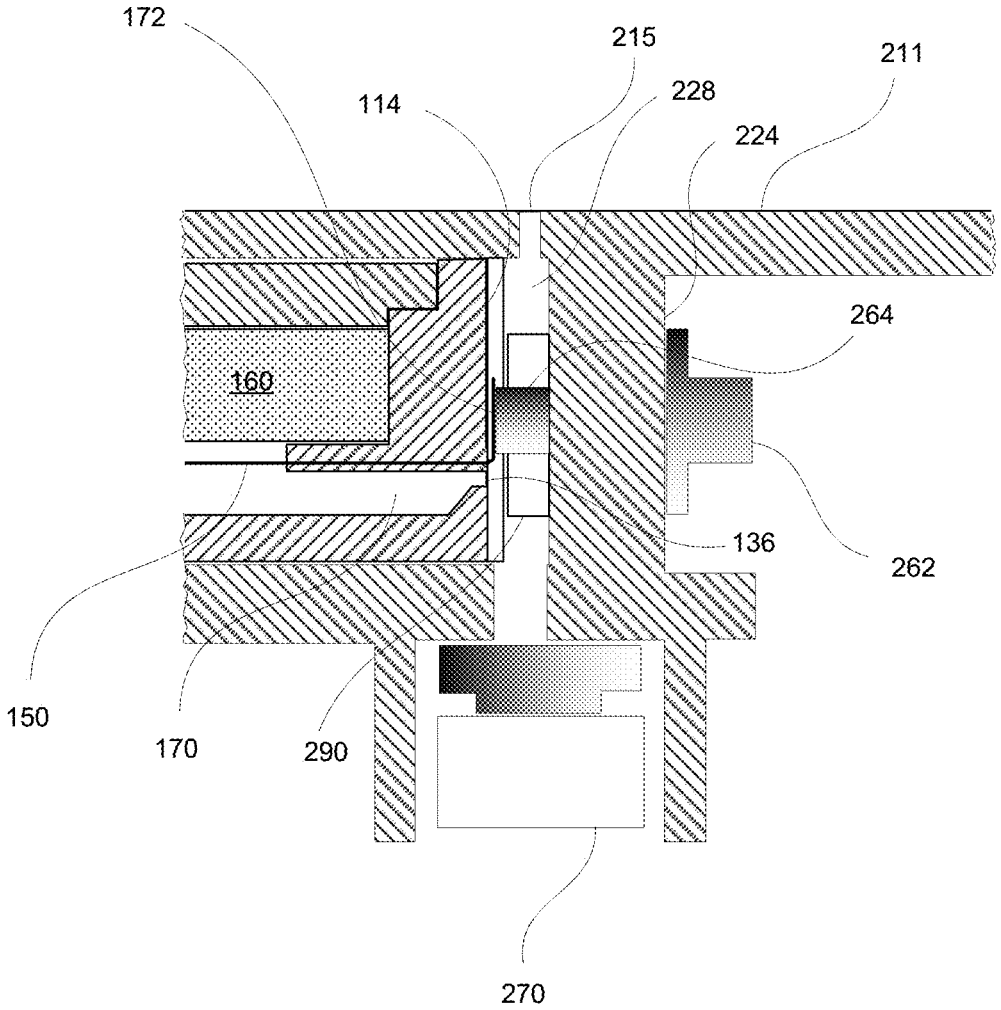
FIG. 16 is a section view of a portion of a mated heating element assembly according to an embodiment of the invention.

The cartridge case 110 and the receiver case 210 are configured so that in the fully mated, operational configuration of FIGS. 15C and 16, the receiving cavity 222 is sealed except for the receiver air inlet port 215 and the cartridge air inlet 136. The remaining cavity interior space 228 adjacent the base wall 224 acts as an air passage between the receiver air inlet port 215 and the cartridge air inlet 136. As a result, when the cartridge 100 and the receiver case 200 are fully mated, inhalation by a user at the exit port 142 serves to draw air through the receiver inlet port, into and through the interior space 228, into and through the cartridge air inlet 136, and into the main passage 170 of the cartridge 100. In embodiments having an air switch 270, the pressure drop across the interior space 228 may also serve to cause the air switch 270 to energize the electrode circuit.

Figure 9:
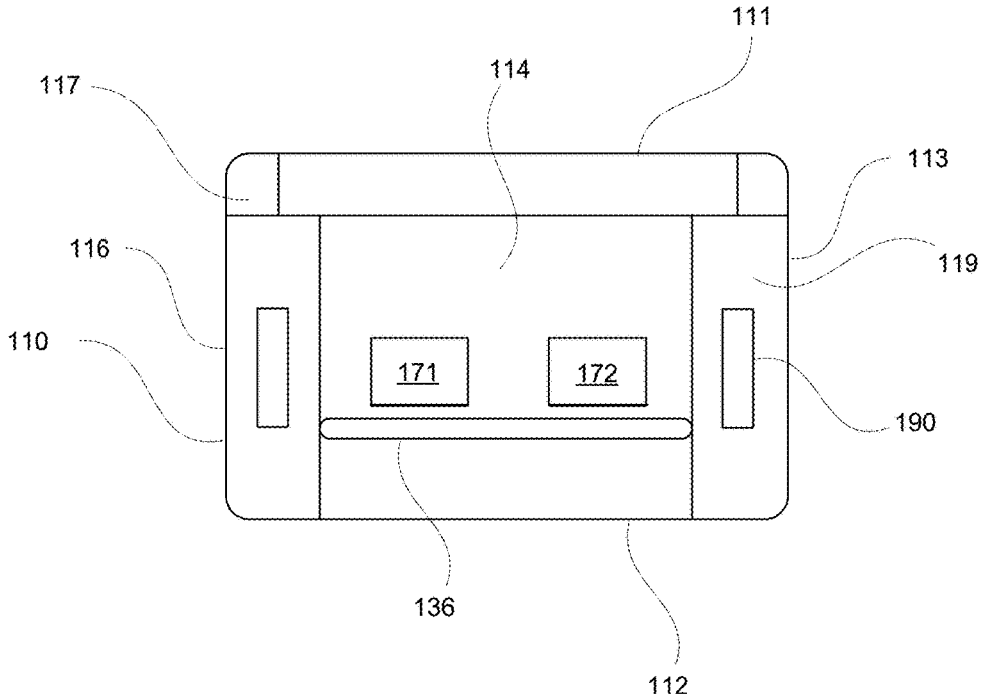
FIG. 9 is an end view of the distal end of a heating element cartridge according to an embodiment of the invention.
Figure 10:
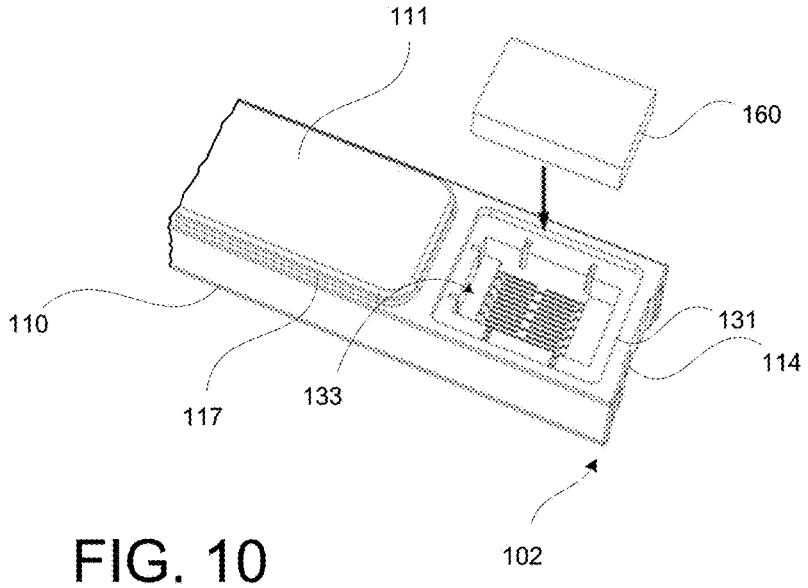
FIG. 10 is a perspective view of a portion of the case structure and the heating element of a vaporizer heating cartridge according to an embodiment of the invention during installation of a liquid transport structure.
Figure 11:
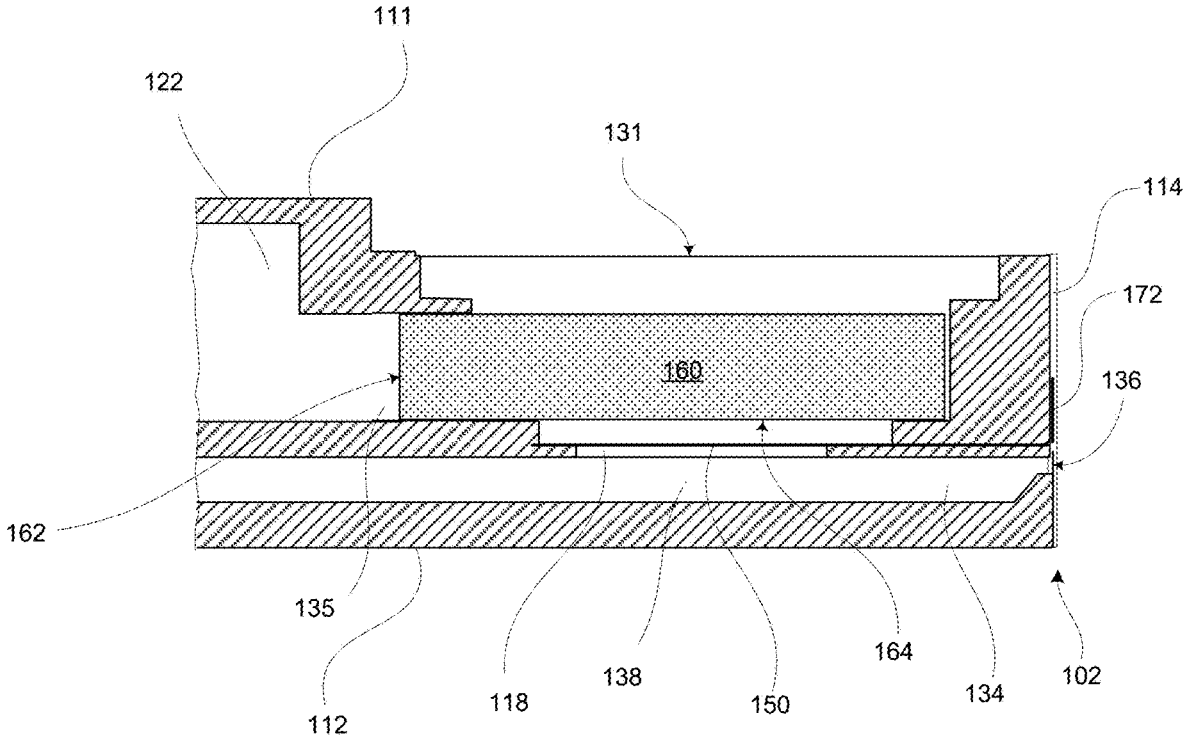
FIG. 11 is a sectional view of a portion of the vaporizer cartridge of FIG. 3 prior to installation of the access opening closure element.

In some embodiments, a cartridge retention arrangement may be used to keep the cartridge in the operational configuration shown in FIG. 15C. In particular embodiments such as the illustrated embodiment, the retention arrangement may include one or more magnets 290 mounted to the receiver case 210 in or adjacent the cartridge receiving cavity 220. These magnets may be sized and positioned to magnetically maintain engagement with corresponding metal plates 190 (see FIG. 9) mounted to the cartridge case 110. Other mechanisms such as retaining clips or mechanical detents may also be used.

In the fully mated configuration of FIGS. 15C and 16, the vaporizer system 1000 may be operated like a conventional personal vaporizer. In use, the user places the proximal end of the mouthpiece in his mouth and inhales. If equipped with an air switch, the action of inhaling simultaneously causes energization of the electrode power circuit. If not so equipped, the user engages the external switch to activate the circuit. Upon activation of the circuit, power is passed from the power source 250 to the electrodes 2626 and into the flat plate heating element 150 through the contact tabs 171, 172. The resistance heating element 150 begins to heat the outflow surface 164 of the liquid transport structure 160 in the cartridge 100. Vaporizable liquid drawn from the reservoir 122 to the outflow surface 164 is heated to vaporization. As this occurs, the pressure differential applied by the user draws air into the main passage 170 through the cartridge inlet 136. At the same time, vapor products and/or unvaporized liquid are drawn through the heating element 150 into the vaporization/mixing section 138 where they are further heated and mixed with air in the main passage 170. The resulting mixture of air and vaporization products is then drawn through the passage 170 into and through the mouthpiece exit chamber 144 and out through the exit port 142.

It will be understood that there may be many other configurations for the vaporizer components and air passageways. In some configurations, for example, there may be multiple air inlet ports through the receiver case leading into the cartridge receiving cavity. In other configurations, a mating passageway may be used to bypass the receiving cavity, connecting up directly to the cartridge air inlet. There may also be additional liquid flow passages and/or wicking structures to provide communication between the reservoir and the liquid transport structure.

It will be understood that the simplicity of the cartridge construction and internal features (e.g., low cost flat plate heating element and wick structures) make it possible to produce large numbers of cartridges at very low cost. Of particular advantage is use of a low cost flat plate heating element designed for use in conjunction with molded plastic retaining structure. This combination requires few or new additional materials for isolation of the heating element. In addition, the heating element can be configured with a low expected operational life-span that need only exceed the number of uses required to exhaust the liquid from the reservoir. This makes it practical for the cartridges to be removed, discarded, and replaced upon exhaustion of the liquid. Ultimately, the combined life cycle cost of the reusable cartridge receiver and cartridge replacements may be the same or lower than prior art refillable vaporizer systems with the added benefit of never needing to go through the hassle of refilling.

While the foregoing illustrates and describes exemplary embodiments of this invention, it is to be understood that the invention is not limited to the construction disclosed herein. The invention can be embodied in other specific forms without departing from the spirit or essential attributes.

What is claimed is:

1. A vaporizer cartridge comprising:

a cartridge case having a plurality of cartridge case walls defining a cartridge case interior, the cartridge case being sized and configured for mating with a cartridge receiver;

a flow passage within the case interior extending from a cartridge air inlet to a mouthpiece exit port, the cartridge air inlet and the exit port each being formed through one of the plurality of cartridge case walls;

a liquid reservoir configured for receiving a vaporizable liquid therein;

a resistive heating element having a central heating portion in electrical communication with positive and negative electrical contact tabs, the central heating portion being positioned within the case interior adjacent a portion of the flow passage and the positive and negative contact tabs each extending outside the cartridge case through one of the plurality of cartridge case walls, the positive and negative contact tabs being configured for engagement by complementary electrical contacts of the cartridge receiver when the cartridge case is mated to the cartridge receiver;

a fluid transport structure disposed within the case interior and having an intake surface in fluid communication with the liquid reservoir and an outflow surface adjacent or in contact with the heating element, the fluid transport structure being configured for transfer of the vaporizable liquid from the reservoir to the outflow surface; and a receiving well in which the resistive heating element and the fluid transport structure are positioned, wherein the receiving well is in communication with the liquid reservoir via a reservoir window, and wherein the receiving well is in fluid communication with the flow passage via a vaporization window.

2. A vaporizer heating cartridge according to claim 1, wherein the resistive heating element is a thin plate heating element having upper and lower plate surfaces and being positioned so as to span the vaporization window with the central heating portion in registration with the vaporization window, the upper plate surface of the thin plate heating element being adjacent or in contact with the outflow surface of the fluid transport structure.

3. A vaporizer heating cartridge according to claim 2, wherein at least a portion of the thin plate heating element is embedded within one or more of the plurality of cartridge case walls.

4. A vaporizer heating cartridge according to claim 2, wherein the thin plate heating element comprises a peripheral conduction portion connected to the central heating portion and the positive and negative contact tabs, the peripheral conduction portion being in contact with and supported by the plurality of cartridge case walls.

5. A vaporizer heating cartridge according to claim 4, wherein the central heating portion of the thin plate heating element is isolated from the plurality of cartridge case walls.

6. A vaporizer heating cartridge according to claim 2, wherein the central heating portion comprises a plurality of spaced apart parallel heating strips, spaces between said heating strips defining flow channels through the thin plate heating element.

7. A vaporizer heating cartridge according to claim 1, wherein the resistive heating element is formed from a single sheet of electrically conductive material.

8. A vaporizer heating cartridge according to claim 1, wherein:

the plurality of cartridge case walls are configured so that at least a distal portion of the cartridge case is removably receivable into a cartridge receiver cavity having a cavity base wall to which the complementary electrical contacts are mounted, the plurality of cartridge case walls includes a distal case wall through which the positive and negative contact tabs extend, and the positive and negative contact tabs are configured for electrical engagement by the complementary electrical contacts when the at least a distal portion of the cartridge case is fully received into the cartridge receiver cavity.

9. A vaporizer heating cartridge according to claim 8, wherein:

the plurality of cartridge case walls are configured so that when at least the distal portion of the cartridge case is fully received into the receiver cavity, a cavity space remains between the distal case wall and the cavity base wall, and the cartridge air inlet is formed through the distal case wall so that the flow passage is in fluid communication with the cavity space when the at least a distal portion of the cartridge case is fully received into the receiver cavity.

10. A vaporizer heating cartridge according to claim 1, wherein the cartridge case consists of molded plastic.

11. A vaporizer heating cartridge according to claim 1, wherein the fluid transport structure is or includes a wick structure.

12. A vaporizer heating cartridge according to claim 11, wherein the wick structure comprises a plurality of organic or inorganic fibers.

13. A vaporizer heating cartridge according to claim 1, wherein the fluid transport structure is or includes a composite wick structure comprising a wicking material and an active material selected to impart a desired characteristic to the vaporizable liquid.

14. A vaporizer comprising:

the vaporizer cartridge of claim 1; and the cartridge receiver to which the cartridge case is configured to be mated, the cartridge receiver comprising:

a receiver case having a plurality of receiver case walls collectively defining a receiver case interior and a cartridge receiving cavity separated from the receiver case interior by a cavity base wall, the cartridge receiving cavity being configured for slidably receiving at least a distal portion of the cartridge case therein;

positive and negative receiver contacts mounted to the cavity base wall so that when the at least a distal portion of the cartridge case is fully received into the cartridge receiving cavity, the positive and negative receiver contacts each make physical and electrical contact with a respective one of the positive and negative contact tabs;

a power source disposed within the receiver case interior; and activation control circuitry in electrical communication with the power source and the positive and negative receiver contacts and configured for selectively connecting the power source to the receiver contacts, thereby energizing the resistive heating element when the at least a portion of the cartridge case is fully received into the cartridge receiving cavity.

15. A vaporizer according to claim 14, wherein the resistive heating element is a thin plate heating element having upper and lower plate surfaces and being positioned so as to span the vaporization window with the central heating portion in registration with the vaporization window, the upper plate surface of the thin plate heating element being adjacent or in contact with the outflow surface of the fluid transport structure.

16. A vaporizer according to claim 15, wherein:

the thin plate heating element comprises a peripheral conduction portion connected to the central heating portion and the positive and negative contact tabs, the peripheral conduction portion being in contact with and supported by the plurality of cartridge case walls, and the central heating portion of the thin plate heating element is isolated from the plurality of cartridge case walls.

17. A vaporizer according to claim 15, wherein the central heating portion comprises a plurality of spaced apart parallel heating strips, spaces between said heating strips defining flow channels through the thin plate heating element.

18. A vaporizer according to claim 14, wherein the fluid transport structure is or includes a wick structure.

19. A vaporizer according to claim 14, wherein the activation control circuitry comprises an activation switch mounted to the receiver case, the activation switch being manually manipulable by a user to selectively connect the power source to the positive and negative receiver contacts, thereby energizing the resistive heating element when the at least a distal portion of the cartridge case is fully received into the cartridge receiving cavity.

20. A vaporizer according to claim 14, wherein the plurality of cartridge case walls includes a distal case wall through which the positive and negative contact tabs extend, the distal case wall forming a distal boundary of the at least a distal portion of the cartridge case, and the cartridge case and the cartridge receiving cavity are configured so that when the at least a distal portion of the cartridge case is fully received into the cartridge receiving cavity, a cavity space remains between the distal case wall and the cavity base wall, the receiver comprises at least one receiver air inlet formed through one of the plurality of receiver case walls to provide fluid communication between the cavity space and ambient air exterior to the receiver case when the at least a distal portion of the cartridge case is fully received into the receiver cavity, and the cartridge air inlet is formed through the distal case wall so that the flow passage is in fluid communication with the cavity space when the at least a distal portion of the cartridge case is fully received into the receiver cavity.

21. A vaporizer heating cartridge according to claim 1, wherein the receiving well comprises an outer ledge, an inner ledge, and an intermediate ledge, wherein the outer ledge is closest to said one of the plurality of case walls, the inner ledge is furthest from said one of the plurality of case walls, and the intermediate ledge is between the inner and outer ledges.

22. A vaporizer heating cartridge according to claim 21, wherein the heating element is supported by the inner ledge, the fluid transport structure is supported by the intermediate ledge, and a cap enclosing the receiving well is supported by the outer ledge.

23. A vaporizer heating cartridge according to claim 22, wherein the an exterior of the cap is flush with an exterior of said one of the plurality of case walls.

24. A vaporizer heating cartridge according to claim 21, wherein the cross-sectional area of the receiving well is smaller at the inner ledge than at intermediate ledge, and the cross-sectional area of the receiving well is smaller at the intermediate ledge than at the outer ledge.

25. A vaporizer heating cartridge according to claim 1, wherein the receiving area extends from one of the plurality of case walls toward the case interior.

26. A vaporizer heating cartridge according to claim 25, wherein a cross-sectional area of the receiving well progressively gets smaller toward the case interior.

* * * * *